United States Patent [19]

Bernhardt

[11] Patent Number: 4,555,056

[45] Date of Patent: Nov. 26, 1985

[54] TAMPERPROOF FOOD PACKAGE

[76] Inventor: Daniel Bernhardt, P.O. Box 681, Rutland, Vt. 05701

[21] Appl. No.: 542,138

[22] Filed: Oct. 14, 1983

[51] Int. Cl.[4] ..... B65D 5/64; B65D 43/06

[52] U.S. Cl. ..... 229/45 R; 206/807; 220/257; 220/306; 220/354

[58] Field of Search ..... 229/43, 45 R; 206/807; 220/306, 307, 257, 354, 355, 359, 371, 372

[56] References Cited

U.S. PATENT DOCUMENTS

| | | | |
|---|---|---|---|
| 3,552,634 | 1/1971 | Ollier | 229/43 |
| 3,561,668 | 2/1971 | Bergstrom | 229/43 |
| 4,040,561 | 8/1977 | Phillipon | 229/43 |
| 4,101,047 | 7/1978 | Geppert et al. | 229/43 X |
| 4,124,141 | 11/1978 | Armentrout et al. | 220/306 |
| 4,346,833 | 8/1982 | Bernhardt | 229/43 |
| 4,431,114 | 2/1984 | Kleinfeld | 220/306 X |
| 4,466,552 | 8/1984 | Butterworth et al. | 220/306 X |

FOREIGN PATENT DOCUMENTS

| | | | |
|---|---|---|---|
| 373787 | 6/1932 | United Kingdom | 220/306 |
| 400008 | 8/1933 | United Kingdom | 220/306 |

*Primary Examiner*—Allan N. Shoap
*Assistant Examiner*—Bryon Gehman
*Attorney, Agent, or Firm*—Mark T. Basseches; Paula T. Basseches

[57] ABSTRACT

A food package or the like comprises a receptacle and lid of resilient polymeric material, the lid and receptacle being snap-fittedly connected. A tamperproof membrane is bonded to the receptacle in covering relation of the lid whereby the lid may not be removed without prior removal of the membrane. All portions of the lid are encompassed within the confines of the receptacle whereby opening, as by inadvertent contact with the lid, is prevented.

4 Claims, 3 Drawing Figures

TAMPERPROOF FOOD PACKAGE

BACKGROUND OF THE INVENTION

1. Field of the Invention

The present invention is in the field of food packages and is directed more specifically to a tamperproof food package which may be readily opened for use and reclosed, if necessary, after partial consumption of the contents.

2. The Prior Art

It is conventional for dispensing in vending machines, in catered cafeteria services and in like applications to provide a transparent package formed of polymeric material and provided with a lid or covering member frictionally mounted in closing relation of the package. Packages of the type described are also frequently used in connection with the sale of candy items, etc.

It has been proposed to form packages of the type described with a covering sheet, specifically of heat sealable plastic bonded both to the cover and to a rim of the package or receptacle, devices of the latter type being shown, by way of example, in my U.S. Pat. No. 4,346,833 and in certain of the references cited therein. Provision of a sealing membrane provides the consumer with a high degree of assurance that the contents of the package have not been tampered with.

In packages of the sort illustrated in the above referenced patent, the cover is frictionally retained in position within the receptacle and a high degree of reliance for retaining the cover in the noted position is placed upon the fact that the membrane which is sealingly connected to the rim of the receptacle is likewise sealingly connected to a rim portion of the cover.

Constructions of the type described provide a high degree of security for the contents of the package until the membrane is removed. However, following removal of the membrane, if it is desired to reclose the package, frictional interengagement of the cover in the receptacle does not provide a dependable means for assuring that the package will remain reclosed.

By way of example, any crushing forces exerted on the package have the tendency to cause the cover to pop free. Also, any upward force exerted against the flange of such device would immediately unseat the cover.

Additionally, constructions of the type set forth involve the sealing of the membrane to coplanar surfaces of the package rim and cover flange.

Such constructions are of necessity of relatively limited structural strength, with the result that when laterally exerted compressive forces are applied to the container, following removal of the membrane, there is little resistance to deformation of the container.

Still a further disadvantage of containers of the type described resides in the fact that elements or increments of the membrane remain bonded to the cover after the cover has been removed, presenting a ragged appearance.

Finally, the separation of the cover of such known containers, upon initial opening of the package presents certain difficulties since the formation of an effective seal of the membrane to both cover and container perimeters requires that these parts be closely juxtaposed, making it difficult for the purchaser to reach into the limited clearance spaces between the noted components and pry the cover free.

SUMMARY OF THE INVENTION

The present invention may be summarized as directed to an improved polymeric container for packaging of food portions or the like characterized in that a membrane is secured in covering relation to a snap cap member. The membrane functions to assure that the cap member may not be inadvertently dislodged. Following removal of the membrane, the cap member is constructed and arranged to interfit with complemental portions of the container to provide a snap action closure, minimizing the risk of the cover popping free, as is the case where a simple frictional fit is depended upon when the package is reclosed. All portions of the cap member are disposed within the confines of a plane extending tangent to the surfaces to which the membrane is bonded, whereby dislodgement of the cap as a result of an upward force exerted against the cap is prevented.

A further characterizing feature of the invention resides in the provision of recess areas in the receptacle rim which partially register with flange components of the cap member, whereby the user may readily grip the flanges and open the container.

Still a further characterizing feature of the invention resides in the provision of a unique three dimensional configuration of the rims of both the receptacle and the cap member which, in addition to providing a secure interfit of the cap to the container, also define a rigid perimetric area at the upper end of the package, rendering the same resistant to distortion under laterally applied forces.

It is accordingly an object of the invention to provide a recloseable polymeric package for food articles or the like having a tamperproof seal, the package, after removal of the seal, being securably recloseable.

A further object of the invention is the provision of a package of the type described which may be readily opened and wherein the construction of the interfitting components which assure reclosure of the package also rigidify the package.

Still a further object of the invention is to provide a container of the type described wherein no portion of the cap projects beyond the confines of the container, and yet the cap may be readily removed when desired.

To attain these objects and such further objects as may appear herein or be hereinafter pointed out, reference is made to the accompanying drawings, forming a part hereof, in which.

Figure 1:
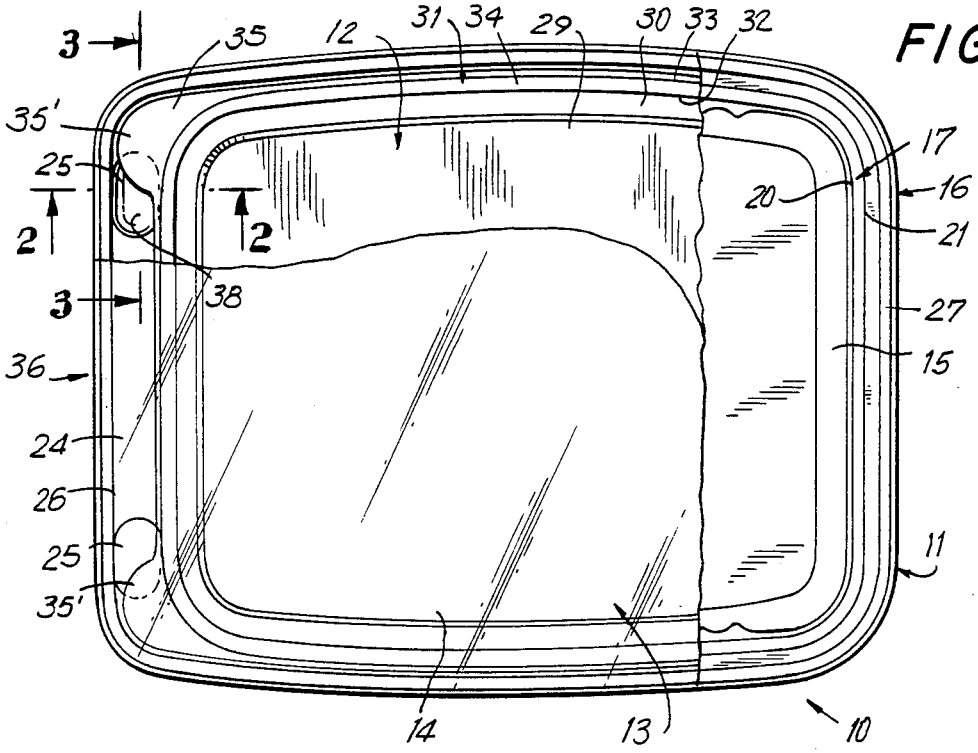
FIG. 1 is a top plan view of a package in accordance with the invention, with portions of the sealing membrane broken away to show details of construction.

Referring now to the drawings, there is disclosed a food package 10 formed of three major components, namely, a receptacle 11, a cover member 12, and a sealing membrane 13. Preferably the noted components are formed of transparent polymeric material, the cover and receptacle being of a rigid and resilient material such as an acetate, polyester or polystyrene composition. Alternatively, the receptacle components may be formed of polymeric foam or an opaque plastic.

The membrane 13 is preferably formed of or coated with a material which may be heat sealingly connected to the receptacle.

The receptacle includes a bottom wall 14, upwardly inclined side walls 15, and a rim assembly 16 extending upwardly from and circumferentially about the uppermost end of the side wall portions 15.

As shown in FIG. 1, the receptacle may be generally rectangular in plan, although it will be readily recognized that the invention is by no means limited to a rectangular configuration.

The rim assembly 16 includes a circumferential rib member 17 extending from the upper edge 18 of the walls 15, there being preferably formed an inner stop shoulder 19 at the interface between the upper end of the walls and the rib 17.

The rib 17 includes downwardly directed inner and outer legs 20, 21, respectively, and a connecting bridge portion 22 which is preferably disposed in a horizontal plane. The legs 21 converge in a downward direction so as to define, in substance, a dovetail configuration.

At the lower end of the outer leg portion 21 there is formed an outer stop shoulder 23 connected to a horizontally directed land portion 24. The land portion 24 adjacent one side of the container, includes one or more depressed portions 25 for purposes which will appear hereinafter.

At the outer terminal circumferential edge 26 of the land portion 24 there is formed an upwardly extending, generally U-shaped configuration 27, the uppermost edge 28 of which is generally planar and defines an anchor surface.

The cap member 12 includes a central closure surface 29, from which depends a circumferential channel area 30 from which projects a bead configuration 31 including inner and outer side walls 32, 33 respectively, connected by top wall 34.

The bead configuration 31 a generally in the for m of an inverted U, the side walls 32, 33 converging in a downward direction and being spaced to mate complementally with the inner and outer side walls 20, 21 of the rib member 17.

A laterally directed flange 35 extends from the outer leg 33 of the bead. The flange 35 includes two enlargements 35', 35' which lie, as best seen in FIGS. 1 and 2 in partial registry with the depressions 25, 25.

As will be appreciated from FIG. 1, the rib and bead portions are essentially identical throughout the circumference of the container except in the side 36 of the container appearing on the lefthand side as viewed in FIG. 1, at which portion of the container the land area 24 is wider than at the remaining circumferential portions of the container.

The depressions 25, 25 are, as shown, formed in such side 36 and the flange 35 is likewise widest in the areas 35', 35' which register with said depressions.

Figure 2:
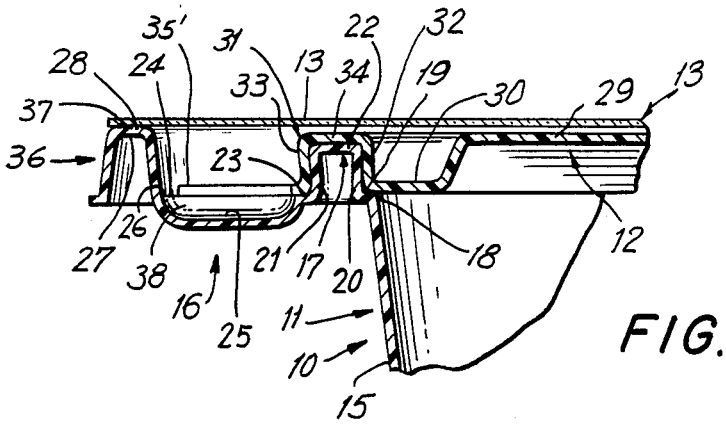
FIG. 2 is a magnified vertical section taken on the line 2—2 of FIG. 1.
Figure 3:
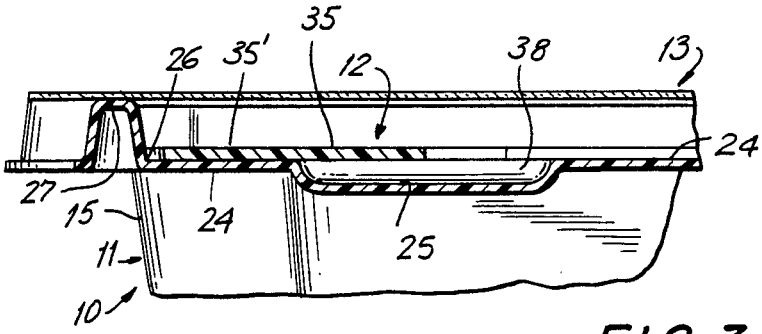
FIG. 3 is a magnified vertical section taken on the line 3—3 of FIG. 1.

As best perceived from FIGS. 2 and 3, the anchor surface 28 is at a level slightly higher than the surface 34 defining the uppermost surface of the bead configuration 31.

It is thus seen that all portions of the cap member, in the mounted position thereof, are encompassed within the space bounded by a plane tangent to the anchor surface 28.

The assembly is completed by the provision of the membrane 13 which is congruent with the outermost perimeter of the anchor surface 28. The membrane 13 is heat sealingly connected along a complete circumferential heat seal line or band 37 to the anchor surface 28.

In such closed position, the lowermost ends of the side walls 32, 33 of the bead 31 bear against the inner and outer stop shoulders 19, 23, respectively, the resilient compressive forces exerted by said walls against the corresponding legs 20, 21, respectively of the rib assembly, tending to urge the lid downwardly.

The functionting of the package will be readily appreciated from the preceding description.

In use, articles to be dispensed are loaded within the receptacle 11 and the cap member 12 snap-fittedly mounted with the rib assembly 17 of the receptacle seated within the bead configuration 31 of the cap. In this condition the members 35', 35' will partially overlie the depressions 25, 25.

With the parts mounted as described, the membrane 13 is heat sealingly connected along seal line 37 to the anchor surface 28. In this condition the membrane will overlie the cap member, and by virtue of the proximate relation of the membrane to the upper surface 34 of the bead configuration, will prevent premature upward movement of the cap.

When it is desired to open the package, the membrane is first removed, such removal being facilitated by the provision of a space in the area below the membrane and above the land portion 24. The user may readily, using a finger nail or the like, puncture the stretched membrane and tear the same free from its connection to the anchor portion 28. Thereafter, the lid 12 may be readily removed by the user reaching into the space 38 defined between the flange portions 35', 35' and the depressions 25, 25.

Where it is desired to reclose the container, it is merely necessary to reposition the lid and press the same downwardly, whereupon a snap closure of the lid to the receptacle is effected by virtue of the coverging wall configurations of the rib and bead structures of the receptacle and cap respectively.

In the closed condition, as a result of the three dimensional configurations defined by the interengaging portions of the receptacle and cap member, there is formed a surrounding rigidifying hoop structure which renders the closed receptacle strongly resistant to lateral crushing forces.

Since no portion of the cap projects from beyond the confines defined by the receptacle and rim assembly, there is no likelihood of the cap being knocked loose from the container inadvertently.

As will be apparent to those skilled in the art and familiarized with the instant disclosure, numerous details of construction may be varied without departing from the spirit of the invention. Accordingly, the same is to be broadly construed within the scope of the appended claims.

Having thus described the invention and illustrated its use, what is claimed as new and is desired to be secured by Letters Patent is:

1. A food package or the like formed of resilient polymeric material comprising a receptacle including a bottom, side wall portions and an integral peripheral rim assembly extending laterally outwardly from the uppermost end of said side wall portions, said rim assembly including a circumferential rib member projecting upwardly from the uppermost edge of said wall portions, said rib member being of the general configuration of a dovetail having downwardly directed converging legs, a generally horizontally directed bridge portion connecting the uppermost ends of said legs, a horizontal land portion extending outwardly from the outermost of said legs, a circumferentially extending inverted U configuration defining an outward extension of said land portion, said U configuration including an uppermost generally planar horizontally directed anchor surface, said surface being disposed in a plane proximate to and above the plane of said bridge portion, said land portion including at least one shallow depression, a cap member snapfittedly mounted to said rim assembly, said cap member including a central portion, a circumferential, downwardly concave bead formed in said cap member, said bead encompassing said dovetail configuration therewithin, the concave surfaces of said bead being in stressed engagement with said legs of said dovetail configuration, thereby to urge said cap member downwardly toward said bottom, at least one horizontally directed flange extending outwardly from said bead, said flange being disposed in partial registry with said depression, and a membrane sealingly connected to said anchor surface along a continuous circumferential connection line, said membrane being disposed intimately adjacent the uppermost surface of said bead, thereby to prevent inadvertent disengagement of said bead from said dovetail configuration, all portions of said cap member being disposed beneath a plane tangent to said anchor surface.

2. A container in accordance with claim 1 and including inner and outer circumferential shoulder portions formed on said receptacle respectively adjacent the inner surface of said inner leg and said outer surface of said outer leg, said cap member including circumferential stop shoulder portions surrounding said bead in pressured engagement with said shoulder portions of said receptacle.

3. A container in accordance with claim 1 wherein said land portion includes two said shoulder depressions and said cap member includes two said flanges, each said flange being in partial registry with a different one of said depressions.

4. A container in accordance with claim 3 wherein said receptacle and cap member are generally rectangular in plan.

* * * * *